United States Patent [19]

Devylder

[11] Patent Number: 5,031,281

[45] Date of Patent: Jul. 16, 1991

[54] WALLET SECUREMENT APPARATUS

[76] Inventor: Emil R. Devylder, 1243 Tamarisk La., Boulder City, Nev. 89005

[21] Appl. No.: 485,050

[22] Filed: Feb. 26, 1990

[51] Int. Cl.[5] ..... A44B 21/00

[52] U.S. Cl. ..... 24/3 H; 24/3 R; 150/134

[58] Field of Search ..... 24/3 H, 3 R; 150/134, 150/133

[56] References Cited

U.S. PATENT DOCUMENTS

| | | | |
|---|---|---|---|
| 978,106 | 12/1910 | Bergenstrohle | 150/134 X |
| 1,121,465 | 12/1914 | Brown | 24/3 H |
| 2,176,387 | 10/1939 | Blakey | 150/134 |
| 3,462,801 | 8/1969 | Bortle | 24/3 R |

FOREIGN PATENT DOCUMENTS

| | | | |
|---|---|---|---|
| 54798 | 8/1923 | Sweden | 24/3 R |
| 7713466 | 9/1978 | Sweden | 150/134 |

*Primary Examiner*—Laurie K. Cranmer
*Attorney, Agent, or Firm*—Leon Gilden

[57] ABSTRACT

Apparatus including a planar leg pivotally mounted adjacent its rear arcuate end to a wallet adjacent the wallet's transverse hinge. The leg includes a forward end extending beyond a right side of the wallet wherein the forward end includes a series of serrations for engagement of an interior side of an individual's pocket preventing inadvertent and unwarranted removal of the wallet from the pocket. Modifications of the invention inlcude resilient deformable portions positioned between the serrations to prevent unnecessary projection of the serrations into the pocket and further permitting a penetration of the serrations into the pocket upon an unwarranted attempt to remove the wallet from the pocket.

2 Claims, 4 Drawing Sheets

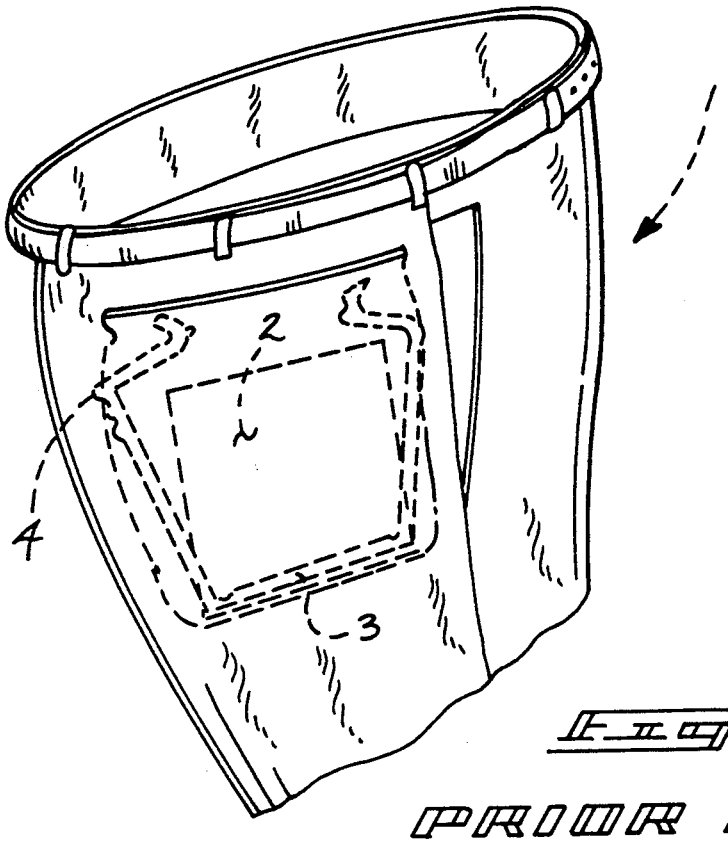
Fig 1
PRIOR ART
Fig 2
PRIOR ART
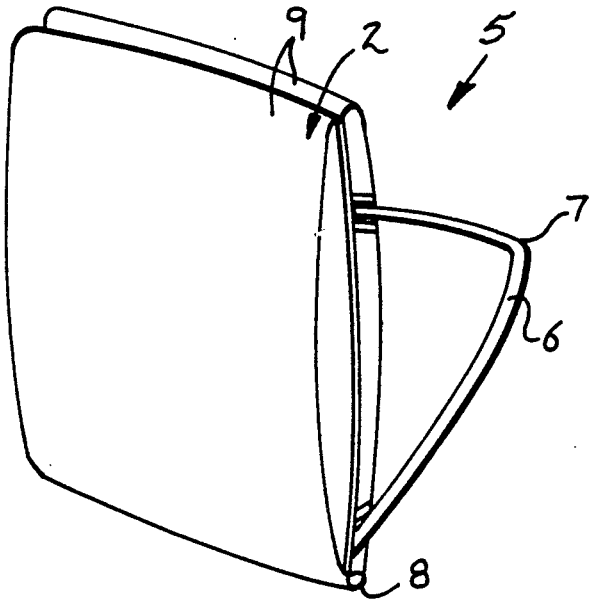

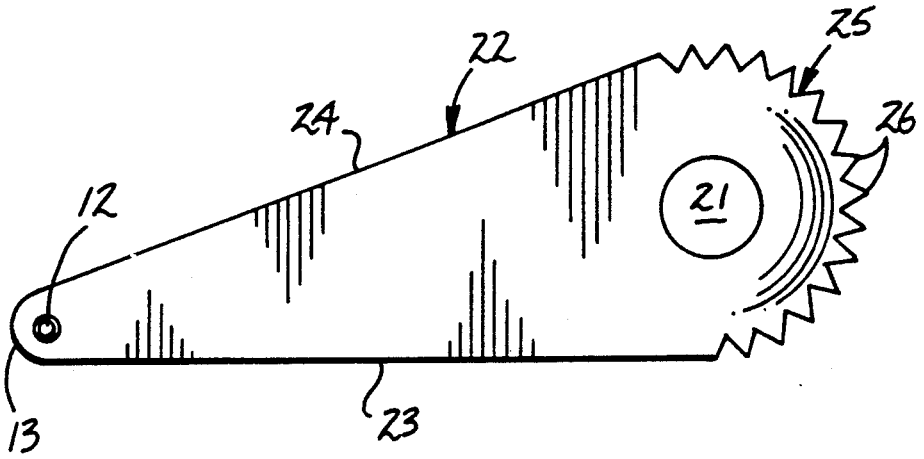
FIG 5
FIG 6
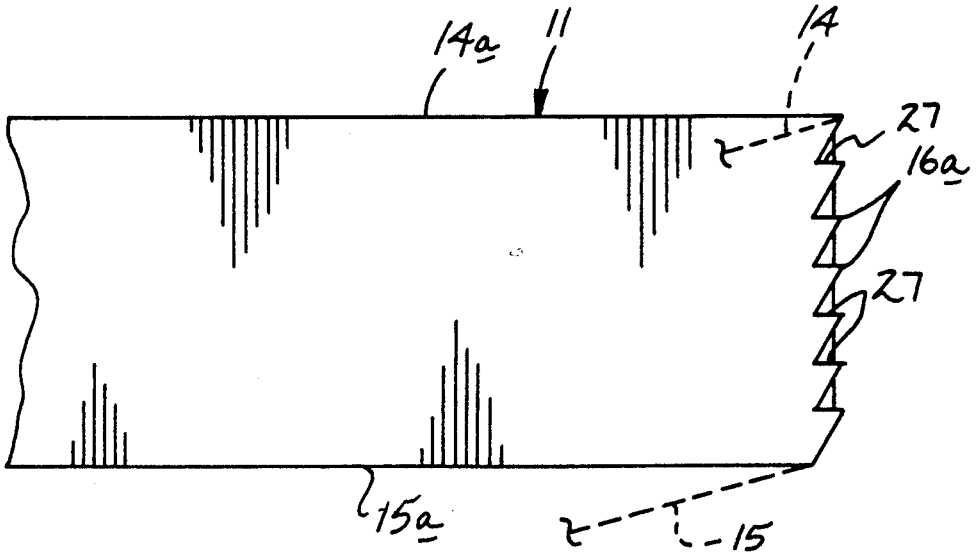

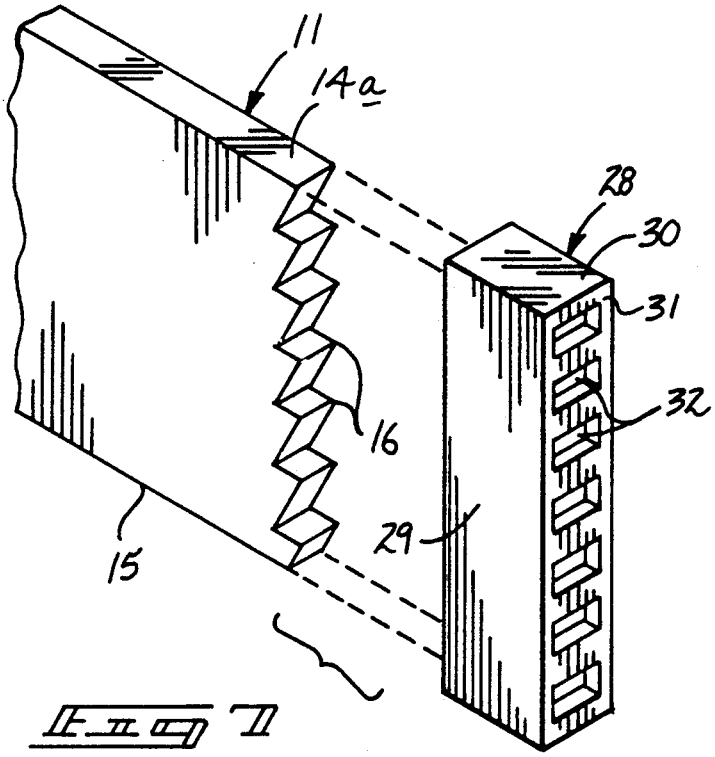
Fig 7
Fig 8
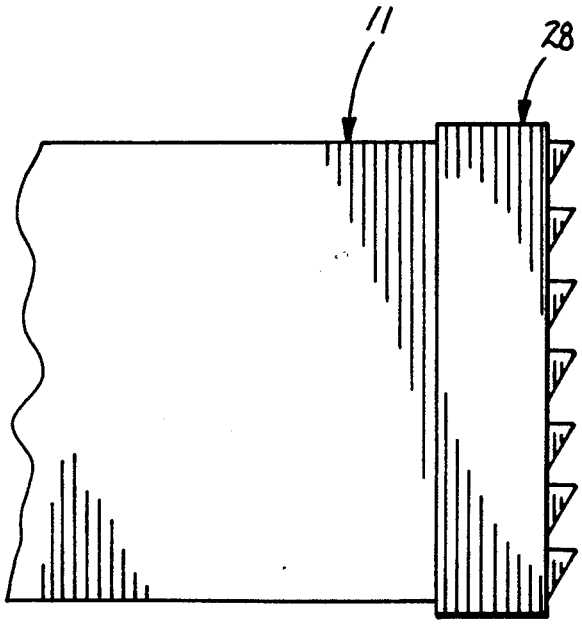

WALLET SECUREMENT APPARATUS

BACKGROUND OF THE INVENTION

1. Field of the Invention

The field of the invention relates to wallet securement apparatus, and more particularly pertains to a new and improved wallet securement apparatus wherein the same includes a plate member to selectively secure a wallet into a pocket preventing unwarranted and unauthorized removal therefrom.

2. Description of the Prior Art

The prior art has provided apparatus to secure a wallet organization within a pocket. The prior art however has heretofore utilized cumbersome structure to effect this purpose or has alternatively included an organization relatively elaborate for achieving a locking of a wallet within a pocket to prevent unwarranted removal therefrom.

Examples of the prior art include U.S. Pat. No. 4,825,922 to ROLFS wherein a wallet includes a resilient tab extending from a forward wall of the pocket to attempt to engage an interior wall of the pocket preventing unauthorized removal therefrom.

U.S. Pat. No. 4,241,476 to CHRISTENSON et al utilizing a generally U-shaped resilient member formed through and secured to the hinge of an associated wallet with the legs of the U-shaped member projecting laterally of the wallet to engage side walls of the pocket preventing unwarranted removal.

U.S. Pat. No. 3,142,876 to ROBERTS illustrates a spring biased generally V-shaped member secured to interior portion of the wallet to engage adjacent ends of the pocket.

U.S. Pat. No. 4,051,123 to OKERELOM illustrates the use of a spring biased leg projecting exteriorly of a side wall of the wallet to engage an interior edge of the pocket preventing removal of the wallet.

U.S. Pat. No. 4,355,440 to JOHANSSON et al utilizes a further example of plural legs projecting laterally of a wallet to engage opposed side edges of a pocket to create abutments preventing unauthorized removal of the wallet from the pocket.

As such, it may be appreciated there continues to be a need for a new and improved wallet securement apparatus wherein the same addresses both the problems of effectiveness in construction as well as ease of application to existing wallet structure and in this respect, the present invention substantially fulfills this need.

SUMMARY OF THE INVENTION

In view of the foregoing disadvantages inherent in the known types of wallet securement apparatus now present in the prior art, the present invention provides an improved wallet securement apparatus wherein the same is pivotally mounted adjacent a transverse folding hinge of an associated wallet and projects laterally of the wallet to engage a side wall thereof. As such, the general purpose of the present invention, which will be described subsequently in greater detail, is to provide a new and improved wallet securement apparatus which has all the advantages of the prior art wallet securement apparatus constructions and none of the disadvantages.

To attain this, the wallet securement apparatus of the instant invention includes an apparatus including a planar leg pivotally mounted adjacent its rear arcuate end to a wallet adjacent the wallet's transverse hinge. The leg includes a forward end extending beyond a right side of the wallet wherein the forward end includes a series of serrations for engagement of an interior side of an individual's pocket preventing inadvertent and unwarranted removal of the wallet from the pocket. Modifications of the invention include resilient deformable portions positioned between the serrations to prevent unnecessary projection of the serrations into the pocket and further permitting a penetration of the serrations into the pocket upon an unwarranted attempt to remove the wallet from the pocket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wallet securement apparatus which has all the advantages of the prior art wallet securement apparatus and none of the disadvantages.

It is another object of the present invention to provide a new and improved wallet securement apparatus which may be easily and efficiently manufactured and marketed.

It is a further object of the present invention to provide a new and improved wallet securement apparatus which is of a durable and reliable construction.

An even further object of the present invention is to provide a new and improved wallet securement apparatus which is susceptible of a low cost of manufacture with regard to both materials and labor, and which accordingly is then susceptible of low prices of sale to the consuming public, thereby making such wallet securement apparatuses economically available to the buying public.

Still yet another object of the present invention is to provide a new and improved wallet securement apparatus which provides in the apparatuses and methods of the prior art some of the advantages thereof, while simultaneously overcoming some of the disadvantages normally associated therewith.

Still another object of the present invention is to provide a new and improved wallet securement apparatus which may be compactly stored when not being utilized.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a prior art wallet securement apparatus within an associated pocket.

FIG. 2 is an isometric illustration of a further prior art wallet securement apparatus.

FIG. 5 is an orthographic side view taken in elevation of a modification of the instant invention utilizing an arcuate forward engagement face.

FIG. 6 is an orthographic view taken in elevation of the instant invention utilizing a deformable material within spaces between the projecting serrations.

FIG. 7 is an isometric illustration of the instant invention utilizing a cap member mounted selectively onto a forward right end overlying the serrations.

FIG. 8 is an orthographic view taken in elevation of the cap as illustrated in FIG. 7.

DESCRIPTION OF THE PREFERRED EMBODIMENT

Figure 3:
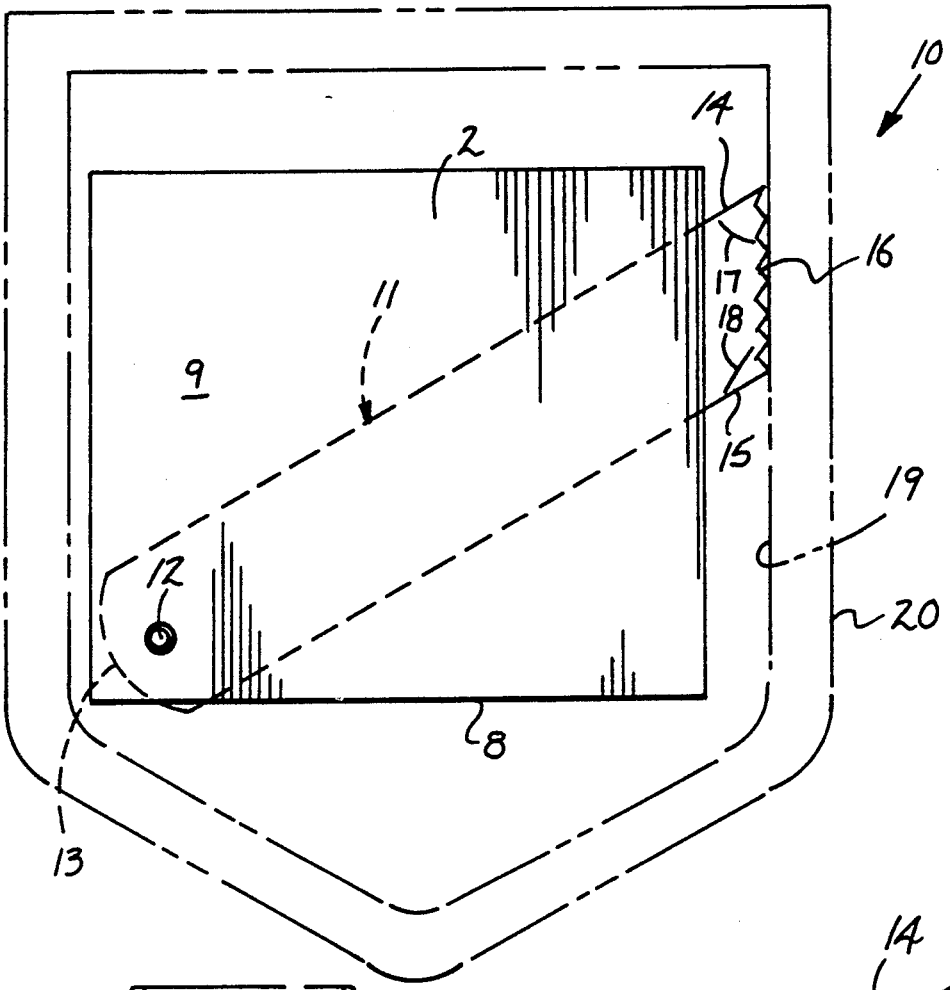
FIG. 3 is an orthographic frontal view taken in elevation of the instant invention mounted within an associated pocket.
Figure 4:
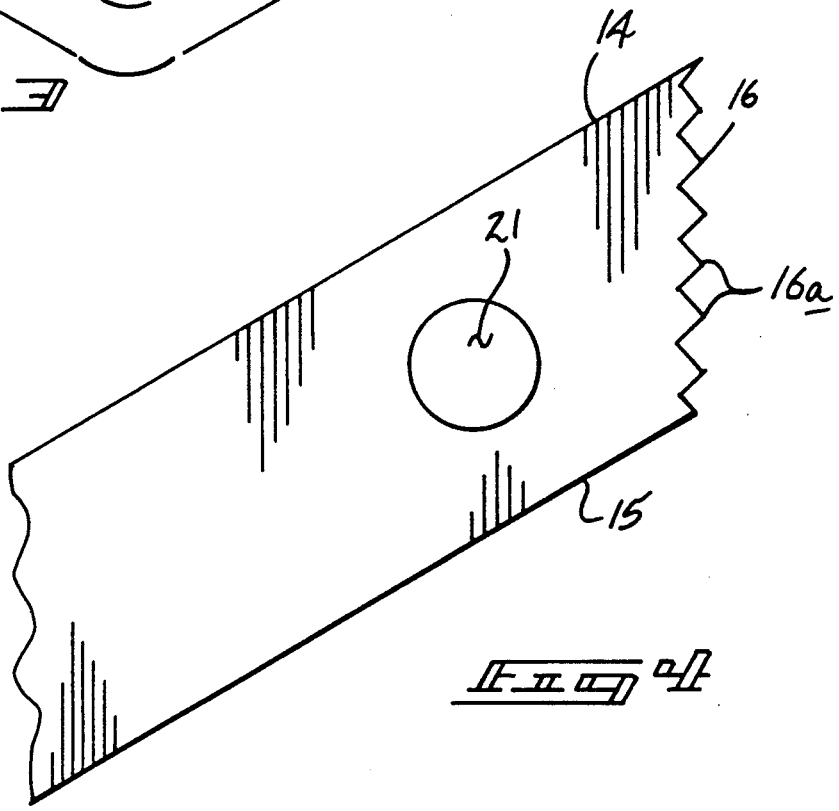
FIG. 4 is an orthographic side view taken in elevation of the instant invention including a finger access opening formed within the securement leg.

With reference now to the drawings, and in particular to FIGS. 1 to 8 thereof, a new and improved wallet securement apparatus embodying the principles and concepts of the present invention and generally designated by the reference numeral 10 will be described.

FIG. 1 is illustrative of a prior art wallet securement device 1 including a wallet 2 with a general U-shaped spring bias member 3 including spaced legs mounted to the hinge of the wallet wherein the legs each include abutments 4 directed to exterior side edges of the associated pocket to anchor the wallet within the pocket. FIG. 2 illustrates a further prior art wallet securement device 5 including a spring biased member 6 with a projection with an elbow 7 for securement within the pocket to anchor the wallet by abutment of the elbow to a side edge seam portion of the pocket. The wallet is of conventional construction utilizing a forward and rear portion 9 pivotally mounted relative to one another by a medial transverse hinge 8.

More specifically, the wallet securement apparatus 10 of the instant invention essentially comprises an elongate planar leg 11 defined by a predetermined length greater than an included predetermined width of the wallet. The wallet includes the aforenoted medial hinge portion 8 pivotally mounting the forward and rear walls 9 of the wallet. The leg 11 mounted between the forward and rear portions 9 of the wallet adjacent the hinge 8 and the left side edges of the portions 9 of the wallet. A pivot axle 12 pivotally mounts the leg adjacent its arcuate left end 13 interiorly of the wallet and is mounted to either a forward or rear wall portion 9 of the wallet in use. The planar leg 11 includes a top longitudinal side 14 and a bottom longitudinal side 15 with a serrated right edge 16 arranged in a non-orthogonal relationship relative to the top and bottom sides 14 and 15. The right edge 16 includes a series of linearly aligned serrations **16*a*. The serrated right edge 16 is defined by an acute included angle 17 between the top side 14 and the edge 16 with an obtuse included angle 18 defined between the right side edge 16 and the bottom longitudinal edge 15. The serrations 16*a* are accordingly arranged for engaging an interior vertical edge 19 of the pocket 20 to prevent unauthorized removal of the wallet. The leg 11 is directed into an engaging orientation relative to the interior vertical edge 19 by gravity as the leg 11 is biased downwardly due to its own weight. A through extending finger access opening 21 is orthogonally directed through the leg 11 adjacent the right side serrated edge 16 to provide a finger access opening to enhance ease of lifting of the leg 11** upon removal of the wallet by its rightful owner.

FIG. 5 illustrates a modification of the instant invention wherein the modified planar leg 22 includes a bottom side edge 23 underlying the top side edge 24 converging to an included acute angle therebetween at the arcuate left end of the leg 22 with the pivot axle 23 orthogonally directed adjacent the left end as illustrated.

The modified leg 22 includes an arcuate right serrated edge 25 including an arcuate series of projections 26 to accommodate a variety of configurations and shapes of pockets and thereby enable engagement of various widths of pockets as the upper portions of the arcuate right edge 25 and its the upper serrations associated therewith will engage pockets of somewhat greater width than those of standard dimension as the leg 22 pivots downwardly within a pocket.

FIG. 6 illustrates the instant invention 11 including a soft deformable polymeric material 27 formed within the spaces between the serrations **16*a*. The deformable material limits projection of the serrated teeth portion 16*a* within the pocket but upon the event of an attempt at authorized removal of the wallet, the deformable polymeric material 27 will compress enabling the serrations 16*a*** to penetrate to a greater depth within the pocket construction.

To provide selective use of a deformable material within the spaces 27 defined between the serrations **16*a*, a removable cap 28, formed of a soft polymeric material, is provided. The cap 28 includes an internal cavity of a complementary cross-section to that defined by the leg 11. The removal cap includes side walls 29 and end walls 30 defining the cavity with a forward wall 31 including a series of parallel slots 32 to receive the teeth or serrations 16*a* therebetween and thereby provide and position the frictional deformable material between the serrations. Further, the use of the cap 28 provides a greater frictional engaging surface defined by the forward wall 31 and the side walls 29 to thereby provide enhanced frictional engagement of the arm 11** within an associated pocket.

As to the manner of usage and operation of the instant invention, the same should be apparent from the above disclosure and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wallet securement apparatus in combination with a wallet, the wallet including a forward portion and a rear portion and a hinge secured to and pivotally mounting the forward and rear portions together, the hinge defined by a predetermined width substantially equal to a width defined by the forward and rear portions, the apparatus comprising, an elongate planar leg defined by a predetermined length greater than a predetermined width, the planar leg includes a rear arcuate end portion and a pivot axle orthogonally directed through the planar leg adjacent the rear arcuate end portion, the pivot axle is directed through the forward portion of the wallet, and the leg further includes a serrated forward edge spaced from the rear arcuate left end portion, the serrated forward edge defined between a top longitudinal side and a bottom longitudinal side of the planar leg, and wherein the serrated edge is defined by an acute included angle between the serrated edge and the top longitudinal side, and an obtuse included angle is defined between the serrated edge and the bottom longitudinal side, and wherein the planar leg includes a through-extending opening directed through the planar leg adjacent the serrated edge permitting finger access of the planar leg by an individual, and wherein the serrated edge includes a series of projecting teeth with a series of recesses defined between pairs of adjacent teeth, each of the recesses including a soft deformable polymeric member positioned therewith and spaced below the projecting forward edges of the teeth, and wherein the soft deformable polymeric member is defined by a removable cap, the removable cap defining an internal cavity of a cavity cross-sectional configuration complementary to a further cross-sectional configuration defined by the planar leg, and wherein the removable cap includes flexible planar side walls, respective spaced flexible upper and lower end walls, and a flexible forward wall, the flexible forward wall including a series of spaced parallel slots directed therethrough spaced apart by a predetermined spacing substantially equal to a predetermined spacing defined between the serrations.

2. Apparatus set forth in claim 1 wherein the planar leg is rigid.

* * * * *